US008683828B2

(12) United States Patent
Neralich

(10) Patent No.: US 8,683,828 B2
(45) Date of Patent: Apr. 1, 2014

(54) GUIDE KIT FOR KNITTING/CROCHETING

(76) Inventor: Katherine Neralich, Mississauga (CA)

( * ) Notice: Subject to any disclaimer, the term of this patent is extended or adjusted under 35 U.S.C. 154(b) by 420 days.

(21) Appl. No.: 12/837,619

(22) Filed: Jul. 16, 2010

(65) Prior Publication Data

US 2010/0319407 A1 Dec. 23, 2010

Related U.S. Application Data

(63) Continuation-in-part of application No. 12/217,631, filed on Jul. 8, 2008, now abandoned.

(51) Int. Cl.
*D04B 3/00* (2006.01)

(52) U.S. Cl.
USPC ..... 66/1 A; 66/1 R

(58) Field of Classification Search
USPC ..... 66/1 A, 1 R; 206/574
See application file for complete search history.

(56) References Cited

U.S. PATENT DOCUMENTS

| | | | | | |
|---|---|---|---|---|---|
| 457,166 | A * | 8/1891 | Olsson | 283/115 |
| 748,939 | A * | 1/1904 | Faust | 283/115 |
| 1,538,718 | A * | 5/1925 | Mehlem | 283/115 |
| 2,142,767 | A * | 1/1939 | Stemm | 66/1 A |
| 2,301,410 | A * | 11/1942 | Kaplan et al. | 434/95 |
| 2,435,068 | A * | 1/1948 | Bellamy | 66/169 R |
| 2,511,947 | A * | 6/1950 | Samuels | 66/1 A |
| 3,384,220 | A * | 5/1968 | Linstead | 206/574 |
| 4,127,191 | A * | 11/1978 | Cave | 206/574 |
| 4,310,313 | A * | 1/1982 | Brundige | 434/95 |
| 4,578,036 | A * | 3/1986 | Leighton | 434/95 |
| 4,792,305 | A * | 12/1988 | O'Donnell | 66/1 A |
| 4,846,351 | A * | 7/1989 | Gardiner | 206/574 |
| 5,150,794 | A * | 9/1992 | Rooks | 206/574 |
| 6,918,490 | B1 * | 7/2005 | Napolitano | 206/574 |
| 7,225,645 | B1 * | 6/2007 | Henneberg | 66/1 R |

FOREIGN PATENT DOCUMENTS

| | | | |
|---|---|---|---|
| EP | 165404 | A1 * | 12/1985 |
| EP | 176250 | A2 * | 4/1986 |

* cited by examiner

*Primary Examiner* — Danny Worrell
(74) *Attorney, Agent, or Firm* — James Ray & Assoc

(57) ABSTRACT

A guide kit for aiding a user in at least one of knitting and crocheting a predetermined item includes at least one template member of at least a portion of the predetermined item, a set of guidelines for one of knitting and crocheting such predetermined item, these guidelines at least including: (i) one of partially knitting or crocheting a predetermined fraction of each portion; and (ii) repeatedly superimposing the fraction on the template during one of knitting and crocheting until portion is complete. Also included are packaging for parts of the guide kit and illustrations on either the guidelines or the packaging providing examples illustrating potential predetermined items.

15 Claims, 3 Drawing Sheets

GUIDE KIT FOR KNITTING/CROCHETING

CROSS REFERENCE TO RELATED APPLICATION

This patent application is related to U.S. patent application Ser. No. 12/217,631 filed Jul. 8, 2008, now abandoned.

FIELD OF THE INVENTION

The present invention relates, in general, to crafting aids and, more particularly, this invention relates to crocheted and knitted clothing, accessories, and the like.

BACKGROUND OF THE INVENTION

Prior to the conception and development of the present invention, customized hand making of garments is generally well known in the prior art, including crocheting and knitting and sewing. In order to craft a particular clothing item or a portion thereof, a pattern with detailed instruction is usually used and followed precisely.

Sewing is a well known art for making clothing that starts with patterns for parts and usually consists of a visual aid depicting the full scale size selected from a limited range and used as a pattern for a one-time cutting out of material into separate portions of the final object. This is followed by sewing the pieces together. Hand crocheting and knitting are different in that allowance must be made for stretching of the final completed item when worn, thus using a template is an appropriate tool when it provides for the stretch in hand crocheting and knitting. In addition existing, crocheting and knitting patterns are typically text style patterns which textually explain all the maneuvers a user must make with particular crafting tools such as a crochet hook or knitting needle and yarns to create the object. It can be very difficult and frustrating for a crafter to try to create an object from a text style pattern. As a result, many people who would like to learn to crochet and knit never try because the textual instructions which are available are too complex and are not enjoyable to follow.

Specifically of interest to the present invention are the following: Leighton, U.S. Pat. No. 4,578,036 discloses a method of instruction for knitting and crocheting in which the location, type, and number of each stitch is exactly indicated on a pattern piece scaled to the final shape of the finished item. With what Leighton teaches, the instructions must be precisely followed and there is no allowance for any creativity on the part of the one making the item.

Kaplan, U.S. Pat. No. 2,301,410, discloses a crocheting guide means including a card divided in vertical rows of designated horizontally-disposed spaces with each space of each row provided with a legend for designating a stitch and directing a row of crocheting, a slide member slidably related to the card for movements vertically thereof over the spaces. Also included is a guide member slidable on the slide member and horizontally of the card having tabs at the upper edge thereof extending upwardly there from and spaced apart to provide a space there between equal to the width of the spaces. Kaplan teaches primarily a card that is meant to be used to mark a stopping point such that a person can quickly determine just where he or she had stopped and resume crocheting there from.

Therefore, there is a need for a more picture-oriented guide for crocheting and knitting clothing items; one which incorporates a picture, some guidelines, and an actual-size template. Also, a crocheting/knitting guide is needed for fostering creativity while providing a more user-friendly means of instruction than the conventional inflexible written instructions accompanied by a pattern.

SUMMARY OF THE INVENTION

The present invention provides a knitting/crocheting guide kit with templates for aiding a user in all parts of knitting and crocheting a predetermined item. Such guide includes template members depicting the actual final size of all parts of such predetermined item. The guide also includes instructions for using the template as a measurement guide for size to build up the predetermined item or portion thereof while fostering and allowing creativity on the part of the user. Also included is packaging for the template and instructions with picture examples of only a fraction of the possible outcomes.

According to another embodiment, a stepwise method of using the guide kit is provided. Such method includes the steps of providing all template members, trimming the chosen ones to a predetermined size and a predetermined shape of a portion of such predetermined item, providing yarn and information about it, needles, hooks, possible stitches, followed by knitting fractions of each portion with frequent superimposing on the template for size only until that portion is complete. When all portions are complete, they are joined to form the predetermined item, generally a garment.

OBJECTS OF THE INVENTION

It is, therefore, one of the primary objects of the present invention to provide knitting and crocheting guide kits similar to sewing patterns but with enhanced flexibility and creativity.

Another object of the present invention is to provide a guide for crocheting and knitting projects which use a template proportioned in size to allow for stretching when put on by the wearer.

Still another object of the present invention is to provide a new method of crocheting and knitting which allows the user from beginner to expert to foster a personal sense of style.

Yet another object of the present invention is to provide a template and method for crocheting and knitting projects allowing for greater user input in multiple ways.

An additional object of the present invention is to provide packaging for the guide kit which can inspire creativity by showing multiple examples of styles of a particular project; for instance, a sweater may be the project and may be crocheted or knitted in a sleeveless style, short-sleeved style, and long-sleeved style in a size chosen by a user and permit both knitting and crocheting in one garment.

In addition to the various objects and advantages of the present invention described with some degree of specificity above it should be obvious that additional objects and advantages of the present invention will become more readily apparent to those persons who are skilled in the relevant art from the following more detailed description of the invention, particularly, when such description is taken in conjunction with the attached drawing figures and with the appended claims. For the purposes of the specification and claims herein, pre-wearing size shall mean that size proportionally smaller than when being worn to account for stretching of the wearable item.

Figure 1:
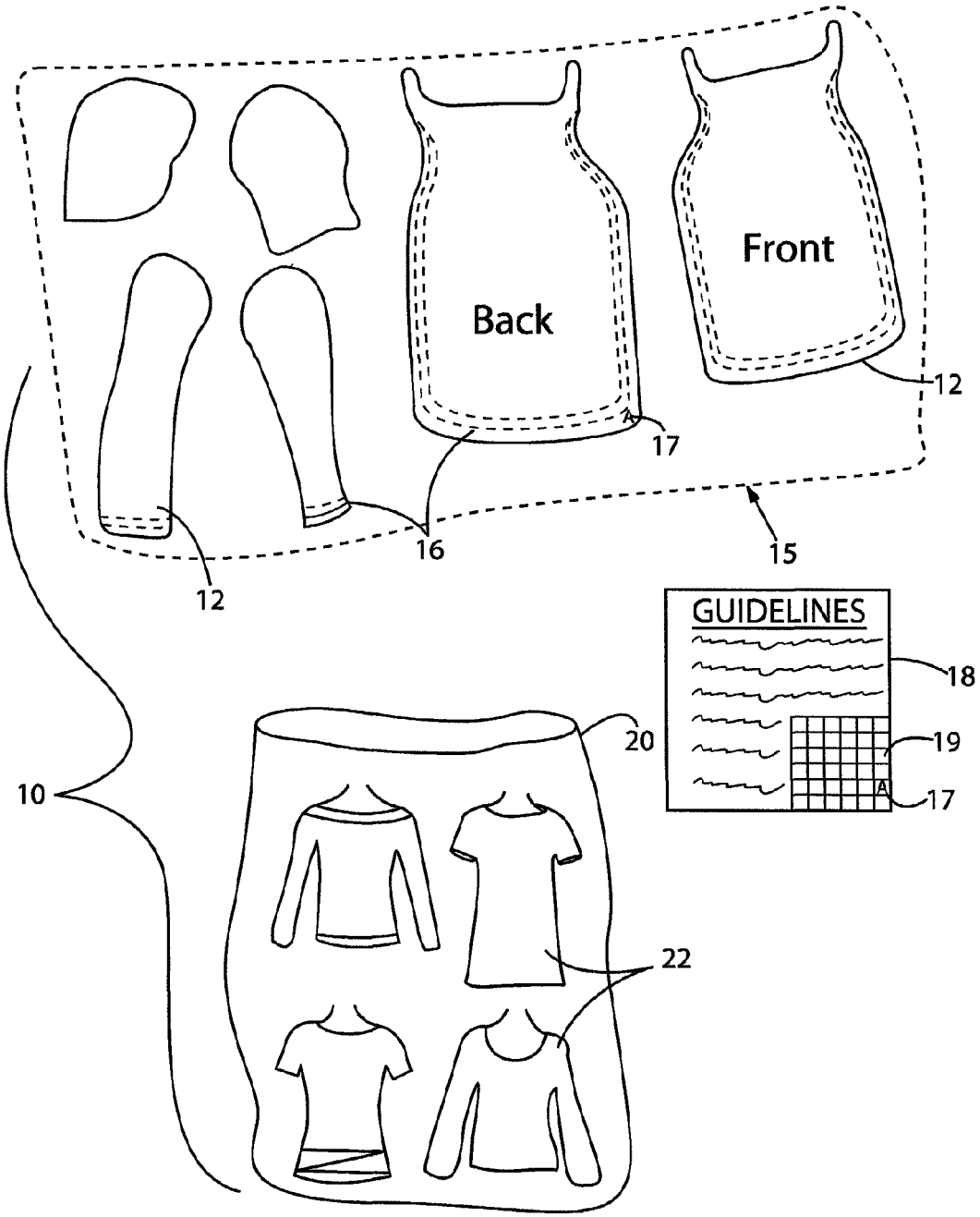
FIG. 1 is a perspective view of the present invention.

DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Reference is now made initially to FIG. 1. A guide kit, generally designated 10, for aiding a user (not shown) in at least one of knitting and crocheting a predetermined item is depicted in a perspective view. Such guide kit 10 includes a template set 15 with all template members 12 trimmable to the actual pre-wearing size and style of at least a finished portion of such predetermined item, but proportioned to the size of the wearer. The knitting or crocheting work-in-progress will frequently be superimposed on this template as it is built up. Unlike typical cloth portions cut for sewing, a knitted or crocheted item will stretch considerably to conform to the body of the wearer. Hence, such template member 12 is manufactured from a preselected material and has a predetermined number and location of size cut lines 16 and a predetermined shape, with the predetermined size cut lines 16 taking into account the stretching that will take place when the completed item is put on by a wearer. The various cut lines 16 will be identified with indicia 17 corresponding to the wearer's size, the indicia 17 typically being numbers or letters. The item will generally be a clothing item, for example a sweater.

It is presently preferred that such preselected material is at least one of durable paper, cardboard, fabric, and plasticized plastic. It is presently preferred that such preselected material is foldable, but also durable for repeated use over the course of several days, as opposed to the delicate tissue paper patterns for sewing which are used once to cut the cloth, then stored or discarded. It is further presently preferred that such preselected material is also readily trimmable.

It is presently preferred that such template member 12 be trimmed so as to be substantially identical to the pre-wearing size of at least a portion of such predetermined item, as shown by illustrations 22 on package 20. It is meant that as such user progresses with the crocheting and/or knitting of such portion of such predetermined item, the completed fraction of a user's crocheted or knitted work may be held against or superimposed on such template member 12 which corresponds to that particular portion of such user's work and such user may gauge a degree of completeness of his or her work.

It is presently preferred that some template members 12 be customizable to a plurality of different designs for making a plurality of different versions of such predetermined item as depicted on package 20 by illustrations 22. For example, the template member 12 may be for a sweater which can be made as a sleeveless sweater, a sweater with short sleeves, three-quarter length sleeves, or full length sleeves. A user would simply crochet or knit the desired sleeve based on the size and shape of the area of the trimmed template which corresponds to the desired sleeve length. In addition, it may be desirable to switch at times from knitting to crocheting then back to add a special emblem or figure, such as a flower.

Such guide kit 10 further includes written guidelines 18 with hints and suggestions disposed on at least one of a predetermined media, or the package 20, or a combination thereof. These written guidelines are not rigid instructions telling such user exactly how to make such predetermined item, but rather guidelines and hints enabling both beginner and experienced user to make the item, and also fostering creativity on the part of the user for customizing the end item. Also, the illustrations 22 on the package 20 may be included inside with the guidelines.

It is optional, but presently preferred, that such guidelines 18 further include a grid chart 19 for aiding the user in choosing the correct cut line 16 by selecting the identifying indicia 17 from the chart 19 matched to both the typical dress size of the wearer and the type and size of yarn to be used. For example, a cotton yarn item typically will not stretch, but acrylic yarn results in an item that stretches considerably, hence a smaller template 12 is needed.

It is presently preferred that the user provide the needles, hooks, and yarn needed, but the guide kit 10 may further include at least one of at least one knitting needle, at least one crocheting hook, at least one spool of yarn, and a combination thereof.

Figure 2:
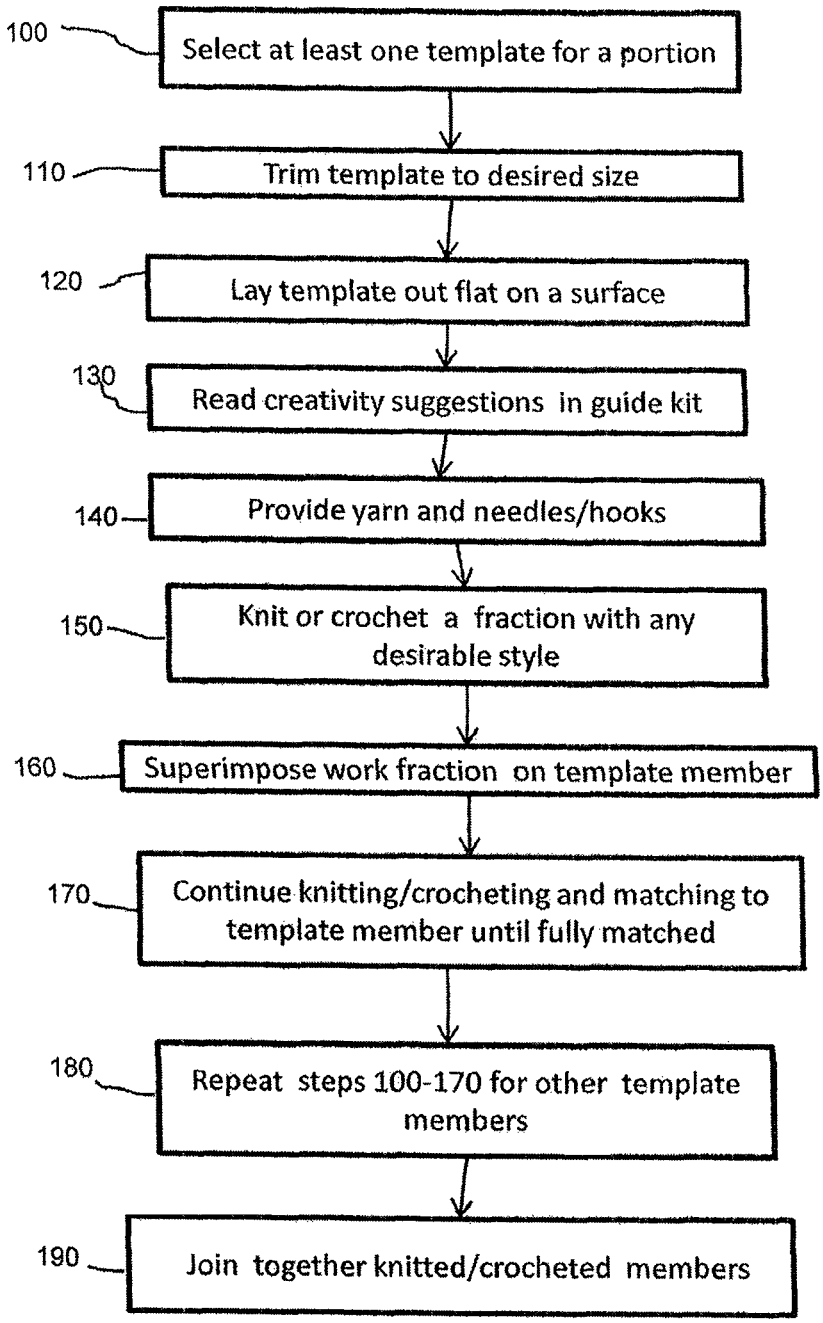
FIG. 2 is a block flow diagram outlining the method for using the present invention.

FIG. 2 depicts a method of at least one of crocheting and knitting a predetermined item utilizing such guide kit. The method begins with the step 100 of selecting a template member for a portion of such item, then in step 110, trimming the template member to the correct size. The template member now corresponds to a pre-wearing size for that portion of such item to be crocheted or knitted.

Next, the user at step 120 lays the template out on a flat surface in preparation for future comparison of the knitting/crocheting work in progress to the desired end result. Before beginning work, the user should optionally be referring to creativity and other hints in the written guidelines in the guide kit, step 130. In the next step, 140, the user provides the yarn and whatever knitting needles and crochet hooks that may be needed.

At step 150, the user begins actual knitting or crocheting, in any desired style, of a first fraction of the portion noting the number of stitches to make the first row match the width of the template. As indicated by step 160, the work is stopped frequently as small additional fractions are completed, and the partially completed portion is superimposed on the template member for ensuring that the knitted work is matching the shape and size of the template member. Corrections can be made as necessary. At certain locations, the user may switch from knitting to crocheting to insert a special section or emblem.

With step 170, the knitting/crocheting work is continued with frequent superimposing on the template member to continue matching, until that portion of the item is completed. With step 180, the user then repeats the steps 100-170 for another portion of the item. When all portions have been completed, they are then assembled and joined together at the appropriate locations to make the final desired item—step 190. Typically, this is done by stitching or sewing.

Figure 3:
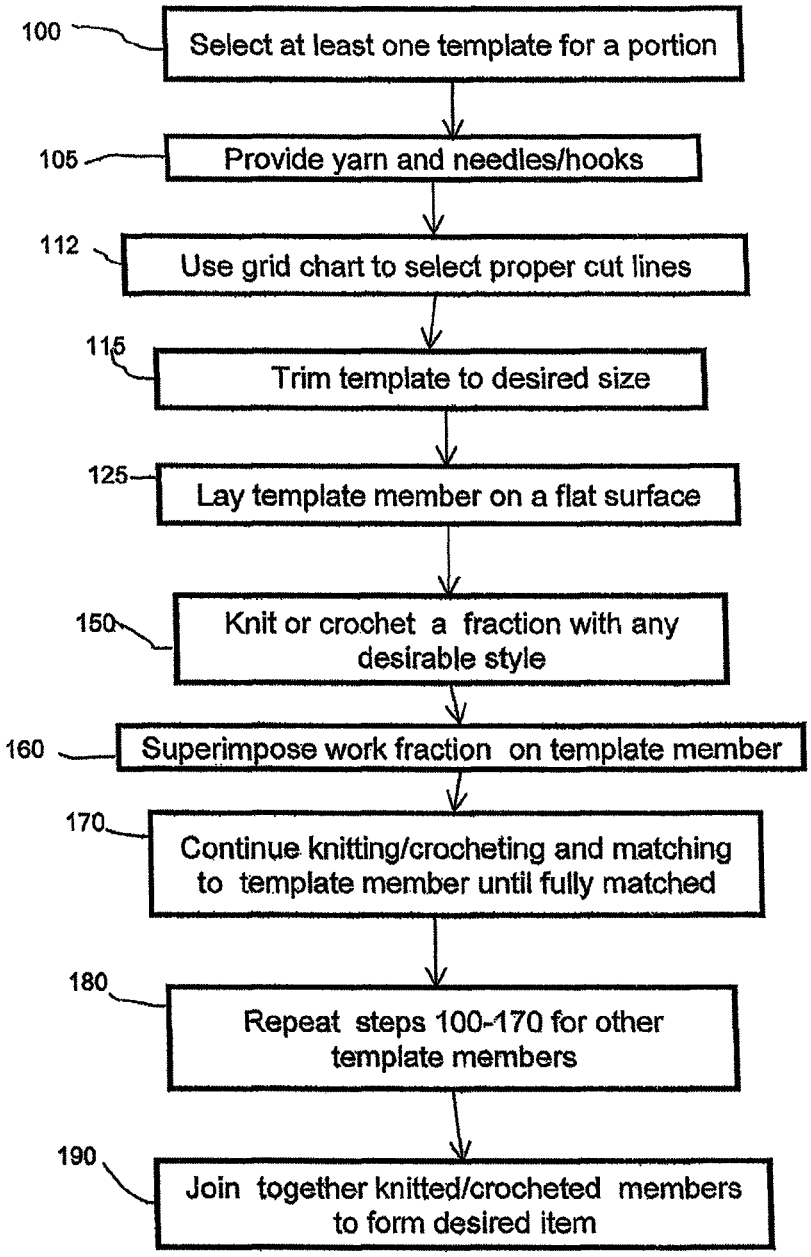
FIG. 3 is a block flow diagram for a method according to an alternative embodiment of the invention.

FIG. 3 provides an alternative embodiment of the method of use. It is very similar to that in FIG. 2 in most respects. After selecting a template to work from at step 100, the yarn is selected before trimming the template member at step 105. At the next step, 112, the user refers to the size selection grid in the guidelines to choose the proper cut lines on the template member based on wearer's typical size and the type and size of yarn selected at step 105. Step 115 calls for trimming the template member at the cut line selected at step 112. The trimmed template is then placed on a substantially flat surface at step 125. Step 150 and those thereafter are the same as in FIG. 2.

While a presently preferred and various alternative embodiments of the present invention have been described in sufficient detail above to enable a person skilled in the relevant art to make and use the same it should be obvious that various other adaptations and modifications can be envisioned by those persons skilled in such art without departing from either the spirit of the invention or the scope of the appended claims.

I claim:

1. A guide kit for aiding a user in at least one of knitting and crocheting a predetermined item, such guide kit comprising:

a) at least one template member of at least a portion of such predetermined item, said template member being manufactured from a preselected material and having a predetermined shape;

b) at least one cut line disposed on a surface of said at least one template member with indicia adjacent said at least one cut line, said indicia configured to identify each cut line;

c) a set of guidelines for one of knitting and crocheting such predetermined item, said guidelines at least including a grid chart containing said indicia so as to allow the user to select said at least one cut line;

d) packaging for said guide kit; and e) illustrations on at least one of said guidelines and said packaging providing examples illustrating potential such predetermined items.

2. The knitting/crocheting guide kit, according to claim 1 wherein said preselected material is at least one of paper, cardboard, fabric, and plasticized plastic.

3. The guide kit, according to claim 1, wherein said preselected material is foldable.

4. The guide kit, according to claim 1, wherein said preselected material is trimmable.

5. The guide kit, according to claim 1, wherein said guidelines are printed on said packaging.

6. The guide kit, according to claim 1, wherein said illustrations are on said package and inside with said guidelines.

7. The guide kit, according to claim 1, wherein said guidelines further include suggestions for possible knitting or crocheting stitches, and general information useful for knitting and crocheting.

8. A method of using a guide kit for at least one of crocheting and knitting a predetermined item, such guide kit including at least one template member, a set of guidelines for knitting/crocheting such item, packaging, and illustrated examples, said method comprising the steps of:

a. selecting at least one such template member for making a portion of said predetermined item;

b. trimming said template member to a predetermined size;

c) laying said template member substantially flat on a surface;

d) providing yarn and at least one of knitting needles and crochet hooks;

e) at least one of knitting and crocheting a fraction of said portion of said item member;

f) superimposing said fraction onto said template member;

g) continuing one of said knitting and crocheting until said item member fully matches said template member;

h) repeating step a-g until all said portions are complete; and i) joining said portions to form said predetermined item.

9. A method of using a guide kit for at least one of crocheting and knitting a predetermined item, such guide kit including at least one template member, a set of guidelines for knitting/crocheting such item, a size selection grid chart, packaging, and illustrated examples, said method comprising the steps of:

a) selecting at least one such template member for making a portion of said predetermined item;

b) providing yarn and at least one of knitting needles and crochet hooks;

c) selecting cut line on said template member using such grid chart;

d) trimming said template member at said cut line;

e) laying said template member substantially flat on a surface;

f) at least one of knitting and crocheting a fraction of said portion of said item member;

g) frequently superimposing said fraction onto said template member during the course of said one of knitting and crocheting;

h) continuing one of said knitting and crocheting until said item member fully matches said pattern member;

i) repeating step a-h until all said portions are complete; and j) joining said portions to form said predetermined item.

10. The guide kit, according to claim 1, wherein said at least one template includes cut lines and wherein said set of guidelines includes indicia configured to identify said cut lines in correspondence to size of a wearer of the predetermined item.

11. The guide kit, according to claim 2, wherein said preselected material is said at least one of paper, cardboard, and plasticized plastic.

12. The guide kit, according to claim 11, wherein said preselected material is foldable.

13. The guide kit, according to claim 1, wherein said preselected material is each of foldable and durable for repetitive use.

14. A guide kit configured to aid a user in at least one of knitting and crocheting an item, said guide kit comprising:

a) a set of templates, each of said set of templates shaped to represent a portion of the item;

b) at least one cut line disposed on a surface of said each template along at least one edge thereof, said at least one cut line configured as a guide to reduce a size of said at least one template;

c) indicia disposed on a surface of said each template and configured to identify said at least one cut line in correspondence to a clothing size of the user of the item; and d) a grid chart containing said indicia so as to allow the user to select said at least one cut line based on a type and a size of a yarn and said clothing size of the user of the item.

15. The guide kit of claim 14, wherein said at least one cut-line is a plurality of cut lines spaced apart from each other along one or more edges of said each template.

* * * * *